US006637411B2

(12) United States Patent
Makiyama

(10) Patent No.: US 6,637,411 B2
(45) Date of Patent: Oct. 28, 2003

(54) FUEL SUPPLY DEVICE HAVING SLIP-OUT PREVENTING MEMBER

(75) Inventor: Takashi Makiyama, Chiryu (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/106,453

(22) Filed: Mar. 27, 2002

(65) Prior Publication Data

US 2002/0139353 A1 Oct. 3, 2002

(30) Foreign Application Priority Data

Mar. 27, 2001 (JP) ..... 2001-089791

(51) Int. Cl.[7] ..... F02M 55/02
(52) U.S. Cl. ..... 123/470; 123/456
(58) Field of Search ..... 123/470, 456, 123/469, 468, 472, 198 D

(56) References Cited

U.S. PATENT DOCUMENTS 5,350,314 A * 9/1994 Saba ..... 439/378
5,520,151 A * 5/1996 Gras et al. ..... 123/470
5,803,052 A * 9/1998 Lorraine et al. ..... 123/470
5,893,351 A 4/1999 Akutagawa et al.
5,970,953 A * 10/1999 Lorraine et al. ..... 123/470
6,053,149 A * 4/2000 Lorraine ..... 123/470
6,148,797 A * 11/2000 Gmelin ..... 123/456
6,276,339 B1 * 8/2001 Shebert, Jr. et al. ..... 123/470
6,360,723 B1 * 3/2002 Nomura ..... 123/470
6,382,187 B1 * 5/2002 Scollard et al. ..... 123/470

* cited by examiner

*Primary Examiner*—Carl S. Miller
(74) *Attorney, Agent, or Firm*—Nixon & Vanderhye P.C.

(57) ABSTRACT

In a fuel supply device, an injector having a fuel inlet whose outer wall of the fuel inlet is inserted into and frictionally engaged via an o-ring with an inner wall of a fuel delivery port. The injector is integrally provided with a connector protruding radially outward. A clip has holes engaged with an outer wall of the fuel delivery port, a pair of opposed arms between which a part of the fuel injector is sandwiched so as to allow the fuel injector to move axially, and two pawls each provided in each end of the arms so as to constitute a stopper which comes in contact with a protruding portion constituting the connector, when the injector is moved in a direction of drawing out of the fuel delivery port, so that the injector never slip out of the fuel delivery port.

6 Claims, 4 Drawing Sheets

FUEL SUPPLY DEVICE HAVING SLIP-OUT PREVENTING MEMBER

CROSS REFERENCE TO RELATED APPLICATION

This application is based upon and claims the benefit of priority of Japanese Patent Application No. 2001-89791 filed on Mar. 27, 2001, the content of which is incorporated herein by reference.

BACKGROUND OF THE INVENTION

1. Field of the Invention

The present invention relates to a fuel supply device in which a fuel injector (injector) connected to a fuel delivery pipe supplies fuel to cylinders of an internal combustion engine (engine).

2. Description of Related Art

As shown in FIG. 6, in a conventional fuel supply device in which injectors 110 supply fuel to cylinders of an engine, each fuel inlet 111 of the injectors 110 are inserted into each delivery port 101 of a fuel delivery pipe 100 and each fuel outlet of the injectors 110 (nozzle side) is to be inserted into the engine (not shown). Each of a clearance between an inner wall of the delivery port 101 and an outer wall of the fuel inlet 111 and a clearance between an inner wall of the engine and an outer wall of the outlet of the injector 110 is sealed by a resilient seal member such as an o-ring 112. Each of the injectors 110 is sandwiched between and fixed to the engine and the fuel delivery pipe 100.

In this supply system, a clip 120 (a joint member) prevents each of the injectors 110 from slipping out of the fuel delivery pipe 100. Accordingly, in a state in which the injectors 110 are assembled to the delivery pipe 100, the fuel supply device can be easily moved to another place for mounting the respective outlets of the injectors 110 on the engine.

However, the conventional clip 120 has a drawback that, once the clip 120 is fitted both in the injector 110 and the fuel delivery pipe 100, the injector 110 can not move axially, that is, in a direction in which the injector 110 is inserted into or drawn out of the fuel delivery pipe 100, since the clip 120 is engaged not only with projections 102 formed in an outer wall of the fuel delivery port 101 but also with a groove 113 formed in the injector 110. Therefore, even if the o-ring 112 for sealing is in an abnormal state due to twisting or getting out of position after the injector 110 has been inserted into and assembled to the fuel delivery pipe 100, the abnormal state can not be easily corrected by further inserting the injector 110 into or drawing out of the fuel delivery pipe 100.

SUMMARY OF THE INVENTION

An object of the invention is to provide a fuel supply device having a slip-out preventing member that allows an injector to be further inserted into or to be drawn out of a fuel delivery pipe, even after the slip-out preventing member is fitted in the fuel delivery pipe and the injector.

To achieve the above object, the fuel supply device has a fuel delivery pipe having a plurality of fuel delivery ports, electrically operated fuel injectors each having a fuel inlet whose outer wall of the fuel inlet is inserted into and frictionally engaged with each inner wall of the fuel delivery ports, a fuel outlet whose outer wall is to be inserted into an internal combustion engine and a protruding portion between the fuel inlet and outlet, and slip-out preventing members each engaged with each outer wall of the fuel delivery ports and holding each of the fuel injectors axially movably at a given distance.

With the fuel supply device, each of the slip-out preventing members has a stopper which comes in contact with the protruding portion of the injector, when each of the fuel injectors is moved in a direction of drawing out of each of the fuel delivery ports, so that the injectors never slip out of the delivery pipe.

In a state in which the injectors are assembled to the delivery pipe, the fuel supply device can be easily moved to another place, for example, for mounting the respective fuel outlets of the injectors on the engine.

It is preferable to dispose a sealing member such as O-ring for sealing a clearance between the outer wall of the fuel inlet and the inner wall of the fuel delivery port.

In this case, even if the sealing member is in an abnormal state due to twisting or getting out of position when the injector is inserted into and assembled to the fuel delivery pipe, the abnormal state can be easily corrected by further inserting the injector into or drawing out of the fuel delivery pipe.

Preferably, the protruding portion is a connecter integrally provided in the fuel injector for supplying an electric power thereto. Accordingly, the fuel supply device is compact.

Further, it is preferable that each of the slip-out preventing members has a pair of opposed arms between which a part of the fuel injector between the protruding portion and the fuel outlet is sandwiched so as to allow the fuel injector to move axially, and two pawls each provided in each end of the arms so as to constitute the stopper.

As an alternative, each of the slip-out preventing members may have a ring plate which surrounds an entire outer circumference of a part of the fuel injector between the protruding portion and the outlet so as to allow the fuel injector to move axially and which constitutes the stopper.

BRIEF DESCRIPTION OF THE DRAWING

Other features and advantages of the present invention will be appreciated, as well as methods of operation and the function of the related parts, from a study of the following detailed description, the appended claims, and the drawings, all of which form a part of this application. In the drawings:

DETAILED DESCRIPTION OF THE PREFERRED EMBODIMENTS (First Embodiment)

Figure 1:
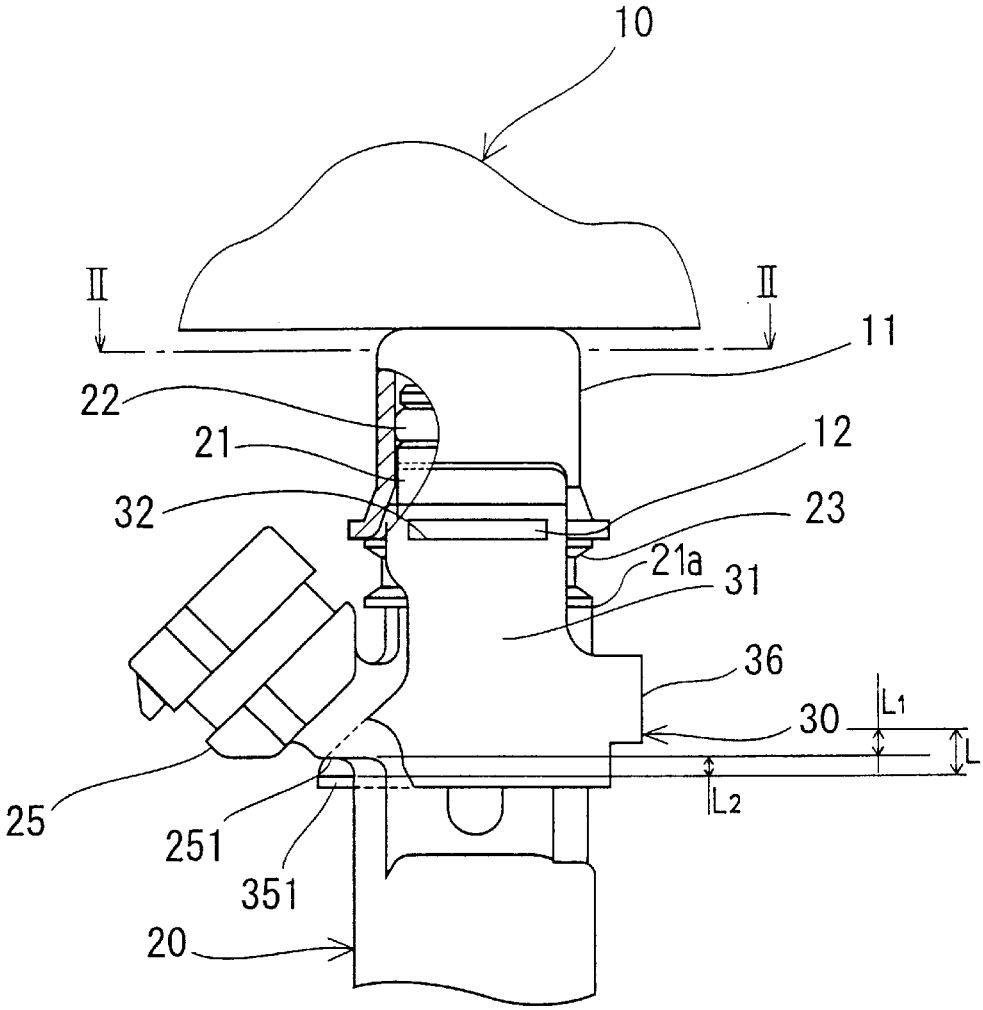
FIG. 1 is a side view showing a fuel supply device according to a first embodiment of the present invention.
Figure 2:
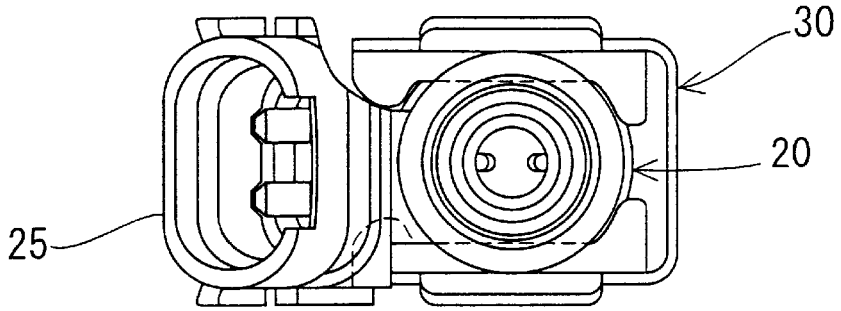
FIG. 2 is a cross sectional view taken along a line II—II of FIG. 1.

A first embodiment of the present invention is described with reference to FIGS. 1 to 4. A fuel supply device is composed of a fuel delivery pipe 10, a plurality of injectors 20 (only one injector 20 is shown in FIG. 1) and a plurality of clips 30 each corresponding to each of the injectors 20. The fuel delivery pipe 10 is provided with a plurality of fuel delivery ports 11 for delivering fuel via the injectors 20 to respective engine cylinders.

Since respective structures of the fuel delivery ports 11, the injectors 20 and clips 30 are same to each other, one of the structures is described hereinafter. The fuel delivery port 11 is provided at an outer wall thereof in a vicinity of the injector 20 with two projections 12 circumferentially spaced substantially at 180° interval. An outer wall of a fuel inlet 21 of the injector 20 is inserted into an inner wall of the fuel delivery port 11. The two projections 12 are inserted into two holes 32 provided in the clip 30, respectively, so that the fuel delivery port 11 is in an engagement with the clip 30. O-ring 22 as a sealing member seals a clearance between the inner wall of the fuel delivery port 11 and the outer wall of the fuel inlet 21. A ring shaped rubber 23 as a resilient member surrounds the outer wall of the fuel inlet 21 and disposed between an axial end of the fuel delivery port 11 and a shoulder 21*a* of the fuel inlet 21. The rubber 23 can be axially contracted and expanded and absorbs vibrations to be transmitted to the injector 20 when the injector 20 is mounted on the engine.

The injector 20 is provided on a side axially opposite to the fuel inlet 21 with a fuel outlet 24 (nozzle) to be inserted via a sealing material (not shown) into each of the engine cylinders (not shown). The injector 20 is provided integrally with an outer wall thereof with a connector 25 protruding radially outward that constitutes a protruding portion 251. The injector 20 is electronically driven in such a manner that a lift of a nozzle needle (not shown) is adjusted by controlling current to be supplied to a coil (not shown) through the connector 25.

The outer wall of the injector 20 on a side of the fuel inlet 21 has two parallel flat surfaces 26 extending axially beyond the connector 25. Each of the flat surfaces 26 is provided with a hole 27 through which inner parts of the injector 20 are clinched.

Figure 3A:
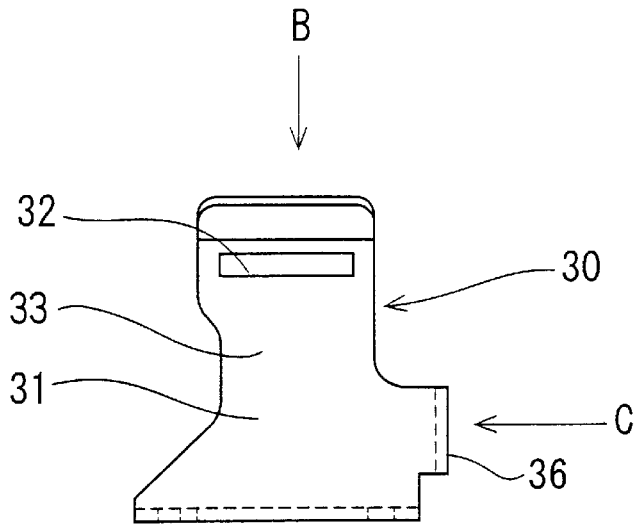
FIG. 3A is a side view of a clip according to the first embodiment.
Figure 3B:
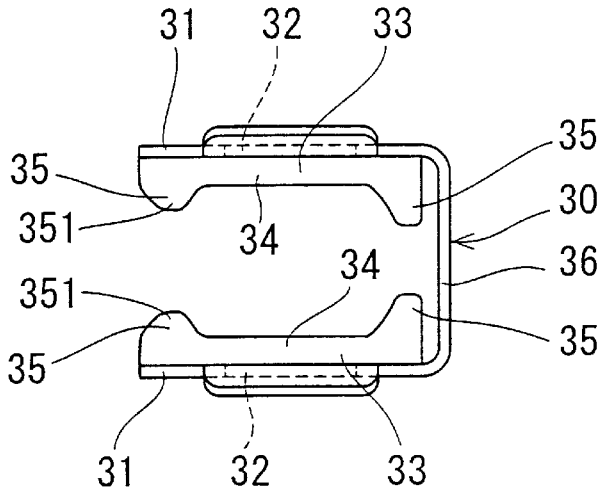
FIG. 3B is a perspective view in an arrow B of FIG. 3A.
Figure 3C:
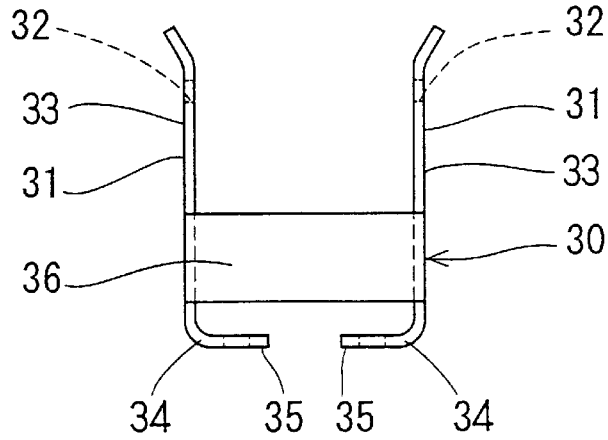
FIG. 3C is a perspective view in an arrow C of FIG. 3A.

As shown in FIGS. 3A to 3C, the clip 30 is composed of a pair of arms 33 and a connecting plate 36 integrally bridging between the arms 33. A cross section of the clip 30 is formed substantially in one side opened square, as shown in FIG. 3B. The arms 33 have a pair of side plates 31 facing in parallel and a pair of bottom plates 34 extending perpendicularly inward from respective ends of the side plates 31 on a side of the fuel outlet 24. Each of the side plates 31 is provided with the hole 32 to be engaged with the projection 12 of the fuel delivery port 11. Respective middle parts of the bottom plates 34 face in parallel to each other with a space whose distance substantially corresponds to a length between the flat surfaces 26 of the injector 20. Respective opposite ends of the bottom plates 34 are provided with pawls 35 further protruding inward so as to partly surround the outer wall of the injector 20 except the flat surfaces 26. The pawls 35 on a side opposite to the connecting plate 36 serve as a stopper 351 that comes in contact with the protruding portion 251 when the injector 20 moves axially.

Figure 4:
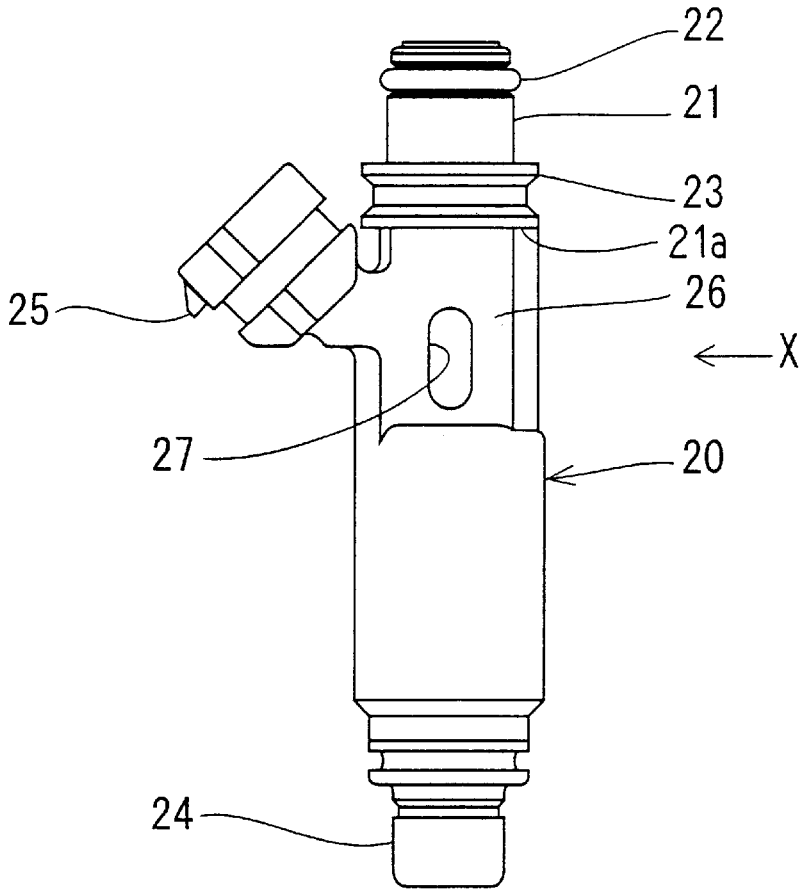
FIG. 4 is a side view of an injector according to the first embodiment.

The clip 30 is assembled to the injector 20 in such a manner that, while the bottom plates 34 on a side opposite to the connecting plate 36 are spread out, the bottom plates 34 are moved in a direction of an arrow X in FIG. 4 to put on the flat surfaces 26 between the stopper 25 and the fuel outlet 24. Once the clip 30 is assembled to the injector 20, parts of the outer surface of the injector 20 extending circumferentially from the flat surfaces 34 are sandwiched between the pawls 35 so that the clip 30 is prevented from slipping out of the injector 20 in an opposite direction of the arrow X.

Then, the fuel inlet 21 with the o-ring 22 is moved toward the fuel delivery port 11 and the rubber 23 is contracted, while the side plates 31 on a side of the fuel delivery port 11 are spread out and, after the outer wall of the fuel inlet 21 is inserted by a given distance into and frictionally engaged via the o-ring 22 with the inner wall of the fuel delivery port 11, the holes 32 are engaged with the projections 121. In a state that the clip 30 makes an engagement with the fuel delivery port 11 and also holds the injector 20, the injector 20 is axially movable in such a manner that the injector 20 is further inserted into the fuel delivery port 11 by a distance L1 so as to further contract the rubber 23 and drawn out of the fuel delivery port 11 by a distance L2 so as to expand the rubber 23, that is, the injector 20 can move axially by a distance L as a total. The movement of the injector 20 toward the delivery port 11 is restricted by contracting the rubber 22 to an maximum and the movement of the injector 20 in an opposite direction to the delivery port 11 is restricted by the protruding portion 251 which comes in contact with the stopper 351. The clip 30 constitutes a slip-out preventing member.

(Second Embodiment)

Figure 5:
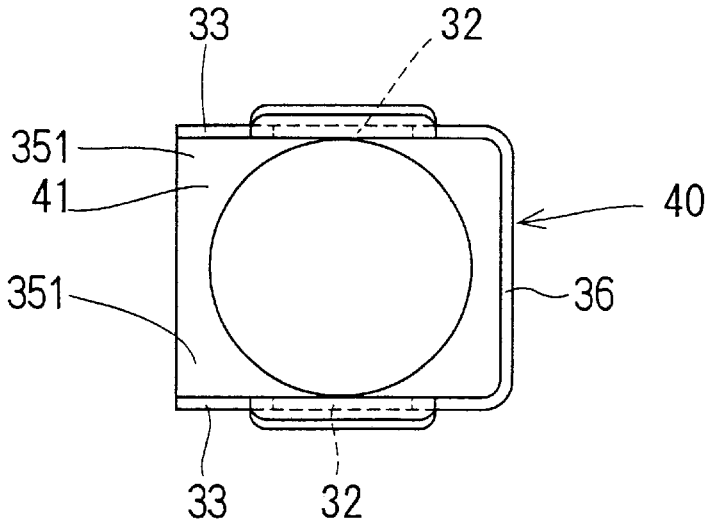
FIG. 5 is a perspective view of another clip as viewed in the same direction as FIG. 3B.
Figure 6:
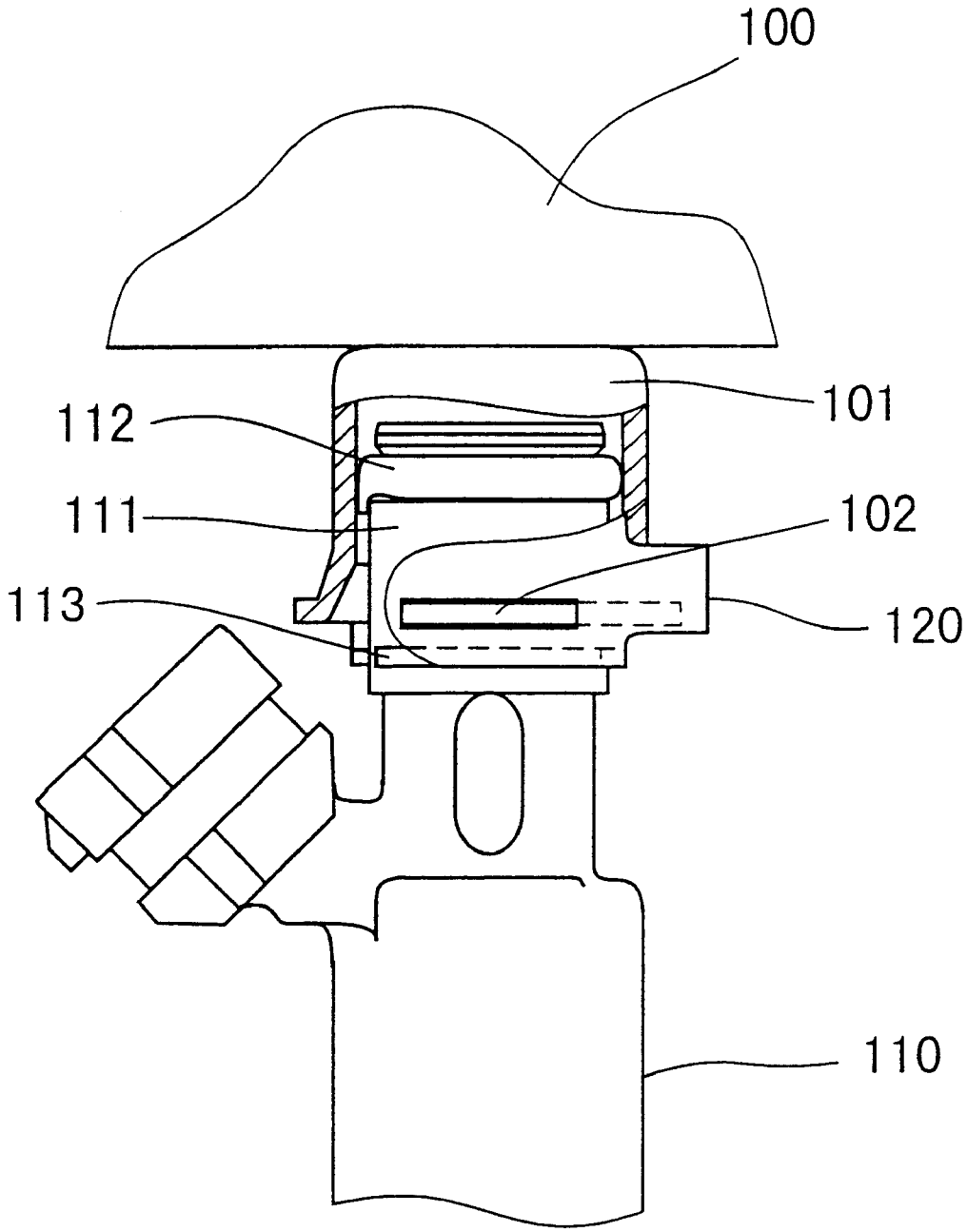
FIG. 6 PRIOR ART
FIG. 6 is a side view of a conventional fuel supply device as a prior art.

A fuel supply device having another clip 40 as the slip-out preventing member according to a second embodiment is described with reference to FIG. 5.

The clip 40 has a ring shaped plate 41 instead of the pair of bottom plates 34 according to the first embodiment. Accordingly, when the clip 40 is assembled to the injector 20, the injector 20 is inserted axially from a side of the fuel outlet 24 into the ring shaped plate 41 so that the ring shaped plate 41 surrounds an entire circumferential surface of the injector 20 and holds the injector 20 axially movable and, then, while the side plates 33 are spread out, the fuel outlet of the injector 20 is inserted into the fuel delivery port 11 so that the holes 32 are engaged with the projections 12. Accordingly, the injector 20 can move axially by a distance L similarly to the first embodiment. The ring shaped plate 41 on a side opposite to the connecting plate serves as the stopper 351 which comes in contact with the protruding portion 251 when the injector 20 is moved in a direction of drawing out of the delivery pipe 10.

According to the second embodiment, the assembly of the clip 40 to the injector 20 and the fuel delivery port 11 is easier since the ring shaped plate 41 is inserted into the injector 20 without spreading out the bottom plates 34 of the first embodiment.

According to the both embodiments mentioned above, even after the clip 30 or 40 is engaged with the fuel delivery port 11 and holds the injector 20, the injector 20 is allowed to move axially by the distance L but is prevented from slipping out of the fuel delivery port 11. Accordingly, in a state in which the plurality of the injectors 20 are assembled to the delivery pipe 10, the fuel supply device can be easily moved to another place, for example, for mounting the respective fuel outlets of the injectors 24 on the engine.

Further, even if the o-ring 22 for sealing is in an abnormal state due to twisting or getting out of position when the injector 20 is inserted into and assembled to the fuel delivery pipe 10, the abnormal state can be easily corrected by further inserting the injector 10 into or drawing out of the fuel delivery pipe 10.

Moreover, though the projecting portion 251 that comes in contact with the stopper 351 is a part of the connector 25 integrally formed with the outer wall of the injector 20 according to the embodiments mentioned above, the projecting portion 251 may be formed separately from the part of the connector 25.

What is claimed is:

1. A fuel supply device for supplying fuel to an internal combustion engine, comprising:

a fuel delivery pipe having a plurality of fuel delivery ports;

electrically operated fuel injectors each having fuel inlet and outlet at axial opposite ends thereof and a protruding portion formed on an outer circumference thereof at a midway between the fuel inlet and outlet, an outer wall of the fuel inlet being inserted into and frictionally engaged with each inner wall of the fuel delivery ports and an outer wall of the fuel outlet being to be inserted into the internal combustion engine; and slip-out preventing members each engaged with each axial end outer wall of the fuel delivery ports and holding each of the fuel injectors axially movably by a given distance, each of the slip-out preventing members having a stopper which comes in contact with and retains a surface of the protruding portion on a side of the fuel outlet, when each of the fuel injectors is moved in a direction of drawing out of each of the fuel delivery ports, so that the injectors never slip out of the delivery pipe.

2. A fuel supply device according to claim 1, further comprising:

resilient members each disposed between each bottom of the fuel inlet and each end of the fuel delivery ports, at least one of the resilient members being axially contracted when the fuel injector is assembled to the fuel delivery pipe so that the resilient member is further axially contracted on further inserting the fuel inlet into the fuel delivery port and axially expanded on drawing the fuel inlet out of the fuel delivery port.

3. A fuel supply device for supplying fuel to an internal combustion engine, comprising:

a fuel delivery pipe having a plurality of fuel delivery ports;

electrically operated fuel injectors each having fuel inlet and outlet at axial opposite ends thereof and a protruding portion at a midway between the fuel inlet and outlet, an outer wall of the fuel inlet being inserted into and frictionally engaged with each inner wall of the fuel delivery ports and an outer wall of the fuel outlet being to be inserted into the internal combustion engine; and slip-out preventing members each engaged with each outer wall of the fuel delivery ports and holding each of the fuel injectors axially movably by a given distance, each of the slip-out preventing members having a stopper which comes in contact with the protruding portion, when each of the fuel injectors is moved in a direction of drawing out of each of the fuel delivery ports, so that the injectors never slip out of the delivery pipe;

wherein the protruding portion is a connecter integrally provided in the fuel injector for supplying an electric power thereto.

4. A fuel supply device for supplying fuel to an internal combustion engine, comprising:

a fuel delivery pipe having a plurality of fuel delivery ports;

electrically operated fuel injectors each having fuel inlet and outlet at axial opposite ends thereof and a protruding portion at a midway between the fuel inlet and outlet, an outer wall of the fuel inlet being inserted into and frictionally engaged with each inner wall of the fuel delivery ports and an outer wall of the fuel outlet being to be inserted into the internal combustion engine; and slip-out preventing members each engaged with each outer wall of the fuel delivery ports and holding each of the fuel injectors axially movably by a given distance, each of the slip-out preventing members having a stopper which comes in contact with the protruding portion, when each of the fuel injectors is moved in a direction of drawing out of each of the fuel delivery ports, so that the injectors never slip out of the delivery pipe;

wherein each of the slip-out preventing members has a pair of opposed arms between which a part of the fuel injector between the protruding portion and the fuel outlet is sandwiched so as to allow the fuel injector to move axially, and two pawls each provided in each end of the arms so as to constitute the stopper.

5. A fuel supply device for supplying fuel to an internal combustion engine, comprising:

a fuel delivery pipe having a plurality of fuel delivery ports;

electrically operated fuel injectors each having fuel inlet and outlet at axial opposite ends thereof and a protruding portion at a midway between the fuel inlet and outlet, an outer wall of the fuel inlet being inserted into and frictionally engaged with each inner wall of the fuel delivery ports and an outer wall of the fuel outlet being to be inserted into the internal combustion engine; and slip-out preventing members each engaged with each outer wall of the fuel delivery ports and holding each of the fuel injectors axially movably by a given distance, each of the slip-out preventing members having a stopper which comes in contact with the protruding portion, when each of the fuel injectors is moved in a direction of drawing out of each of the fuel delivery ports, so that the injectors never slip out of the delivery pipe;

wherein each of the slip-out preventing members has a ring plate which surrounds an entire outer circumference of a part of the fuel injector between the protruding portion and the fuel outlet so as to allow the fuel injector to move axially and which constitutes the stopper.

6. A fuel supply device according to claim 1, wherein the fuel injector is provided at an outer circumference thereof with two parallel flat surfaces extending axially beyond the protruding portion, the slip-out preventing member is a substantially U-shaped clip member having a pair of flat plates fitted in the two parallel flat surfaces and positioned axially between the stopper and the fuel outlet and the stopper is a pair of protrusions extending radially inward at respective leading ends of the pair of flat plates.

* * * * *